United States Patent [19]

Liu

[11] 4,253,691

[45] Mar. 3, 1981

[54] PET LITTER REMOVER AND BAGGER

[76] Inventor: William Y. Liu, 286 Clinton Ave., Apt. 3B, Brooklyn, N.Y. 11205

[21] Appl. No.: 110,987

[22] Filed: Jan. 10, 1980

[51] Int. Cl.[3] ..... A01K 29/00

[52] U.S. Cl. ..... 294/1 BA

[58] Field of Search ..... 294/1 B, 1 BA, 1 BB, 294/19 R, 19 A, 50.6, 50.7, 55, 100, 115; 15/104.8, 257.1

[56] References Cited

U.S. PATENT DOCUMENTS

| | | | |
|---|---|---|---|
| 3,777,708 | 12/1973 | Vogt | 294/1 BB |
| 3,819,220 | 6/1974 | Bredt | 294/1 BB |
| 3,977,422 | 8/1976 | Cabaluna | 294/1 BA |
| 4,078,838 | 3/1978 | Nadratowski | 294/1 BA |

FOREIGN PATENT DOCUMENTS

| | | | |
|---|---|---|---|
| 2413126 | 9/1975 | Fed. Rep. of Germany | 294/1 BA |

*Primary Examiner*—Johnny D. Cherry

*Attorney, Agent, or Firm*—Robert L. Slater, Jr.

[57] ABSTRACT

A litter collecting bag is retained by a clamping device in an open-end of a tubular housing. Pawl means attached to a spring loaded handle slidingly mounted atop the housing engages a sliding toothed rod connected through the housing to the clamping device permitting the litter collecting bag to be drawn into an ejected from the housing. When the collecting bag is pressed by the housing onto a quantity of litter, the litter is driven into the collecting bag. The litter bag self-seals as it is fully retracted into the tubular housing and may be discharged later to dispose of the litter conveniently.

6 Claims, 8 Drawing Figures

PET LITTER REMOVER AND BAGGER

FIELD OF THE INVENTION

The present invention relates to a pet litter retrieving device. In its preferred embodiment, the device of the present invention provides simple and efficient means by which the litter is gathered into sealed, disposable plastic film bags. Use of the device does not require the user to stoop down during the recovery procedure, nor to soil his hands or the retrieving tool during such use.

BACKGROUND OF THE INVENTION

In many densely populated urban centers, most notably in New York, public pressure has resulted in recently enacted statutes which require the pet owner to clean up after his pet. This legislation has created a need for a convenient litter retrieving device which allows the pet owner to remove the offensive material with a minimum of effort and to do so as remotely as possible. Devices which are currently available have many drawbacks in their use. They cannot be used after the pet has littered without stooping. The danger exists that the litter would soil the retriever, his clothes, or unintended portions of the retrieving device. Disposal of the litter and/or litter bag again presents an opportunity to befoul oneself. The prior art litter devices generally require use of both hands to effect retrieval of the litter. Previous devices also develop odors if the retrieved litter could not be disposed of immediately after use. Notwithstanding the array of currently available pet litter retrieving devices, there remains a need for a simple, efficient device which eliminates these failings of the prior art.

OBJECTS OF THE INVENTION

Accordingly, a first object of the present invention is to provide a litter retrieving device that is sanitary and which will not soil the user or the reusable part of the device itself.

An additional object is to provide a device that recovers litter from the ground, and after the pet has littered.

Another object of the present invention is to provide a litter retrieving device that does not require the user to stoop, and which requires the use of but one hand during operation.

Still another object of the present invention is to provide a device that has a means to seal the litter in a container thereby controlling the odor of the retrieved litter.

It is also an object of this invention to provide a device whereby the litter thus retrieved may be transported until a convenient disposal location can be reached.

Yet another object of the present invention is to provide a litter retrieving device that is simple to operate and inexpensive to produce.

These and other objects of the invention will be more apparent upon inspection of the specification, figures and claims.

SUMMARY OF THE INVENTION

The pet litter remover and bagger of the present invention retrieves litter into plastic film bags and comprises an elongated hollow tubular housing member open at a first end, said housing being provided with a longitudinal slot along the side thereof; a hollow tubular handle member slidably engaging the second end of the housing, the handle being attached to the housing by spring means; a retractable rod slidably mounted within the housing and provided with means extending through the slot for controlling the position of the retractable rod with respect to the first end of the housing; means for advancing the retractable rod within the housing by a force applied to the handle and against said spring means; a releasable clamp mounted to the end of the retractable rod, said clamp being constructed to remain in a tightly clamped position when retracted within the housing, and to freely release when said clamp mounted to the retractable rod is projected beyond the open-end of the housing. When the plastic film bag is secured in the clamp by partially drawing the clamp into the open-end of the housing and the open-end of the plastic bag is reflexed externally around the open-end of the housing, a portion of the litter may then be pressed into the interior of the bag. The bag and subsequent portions of litter may be further drawn upward into the interior of the tubular housing by advancement of the retractable rod by forces iteratively applied to the handle until the open-end of the plastic bag no longer extends beyond the housing. In the preferred embodiment, the plastic film bag containing the litter is self-sealing, and the sealed bag can be ejected from the housing by the user without handling the litter bag and without contamination of the litter retrieving device.

DESCRIPTION OF THE FIGURES

FIG. 8 is an alternate embodiment of the invention.

DETAILED DESCRIPTION OF THE INVENTION

Figure 1:
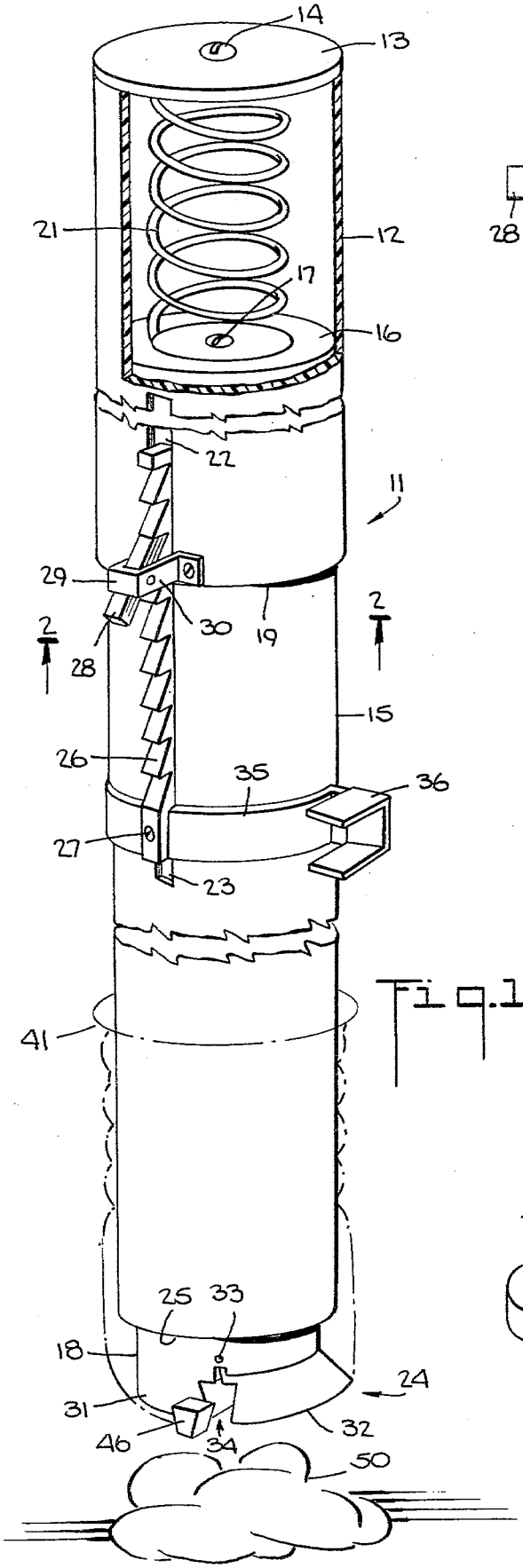
FIG. 1 is a perspective view of the device positioned over a specimen of litter.

FIG. 1 shows a perspective view of the preferred litter retrieval device 11 of the present invention positioned above a litter specimen 50 to be retrieved. Structurally, the device 11 comprises a hollow cylindrical member 12 shown in partial section having a circular top 13 to which spring fastener 14 has been affixed; a hollow cylindrical member 15 also shown in partial section having a circular top 16 to which spring fastener 17 has been affixed, and a retractable cylindrical rod 18. Member 12 serves functionally as the handle for the device 11, while member 15 serves as the housing for the rod 18. The terms handle 12 and housing 15 will be used throughout the remainder of the description.

The housing 15 slidably engages the open-end 19 of the handle 12, and is connected thereto by helical spring 21 attached to respective spring fasteners 14 and 17. Means other than fasteners 14 and 17, however, may be employed. For example, the spring ends may be bonded to circular tops 13 and 16 directly. Alternatively, both ends of housing 15 may be open, and the spring bonded to the side wall proximate to the top section thereof. Preferably, the handle 12 and the housing 15 are made from a clear plastic material which permits molding fabrication means, and allows the user to observe the mechanical operation of the device.

Each member 12 and 15 has a longitudinal slot 22 and 23 respectively, the slot 22 extending from the open end 19 to a point intermediate the handle 12, and the slot 23 residing between the ends of housing 15. When the spring 21 is in its relaxed position, the top of slot 23 is proximate to and in alignment with the slot 22.

Figure 2:
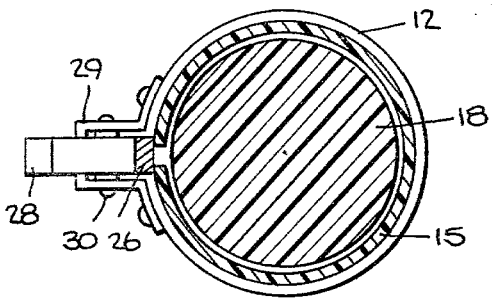
FIG. 2 is a cross sectional view of the device taken along the plane 2—2 of FIG. 1.
Figure 3:
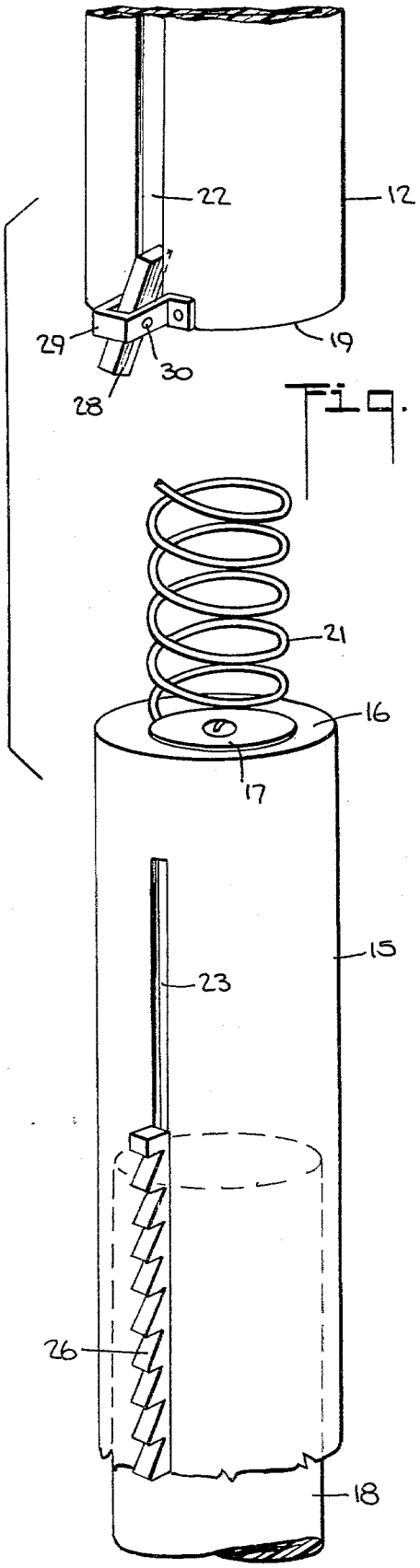
FIG. 3 is an exploded close-up front view in partial section of the device showing the assembly of the device.
Figure 4:
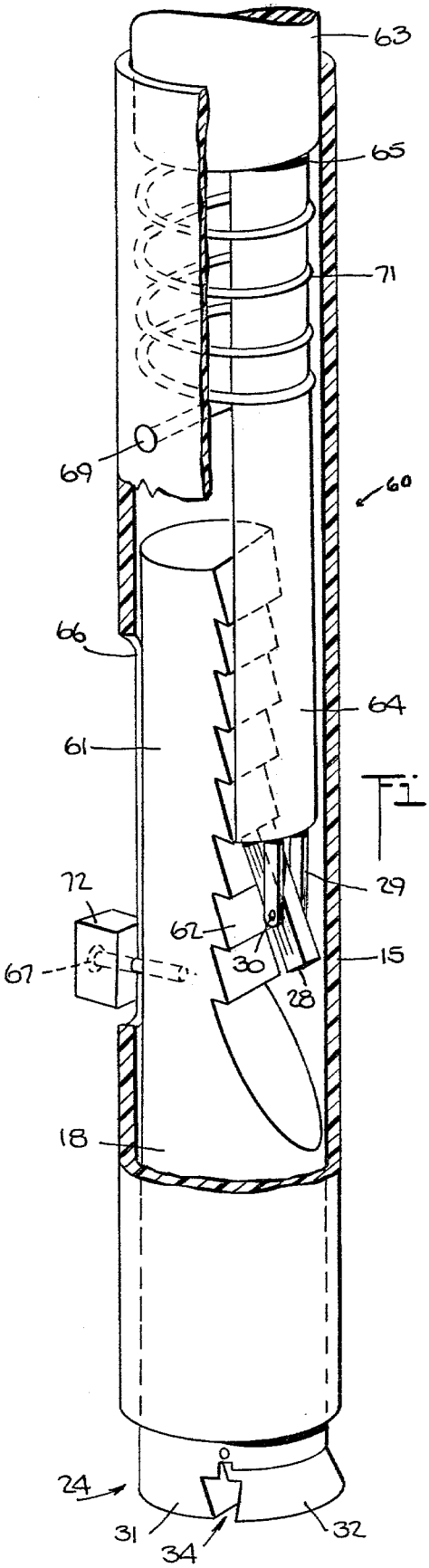

Retractable rod 18 is insertable within the housing 15 through open-end 25, and has a clamp portion 24 at its protruding end as shown in FIG. 1. With the clamp portion 24 extending just past end 25, the rod 18 is fastened to rod advancing means exterior of the housing 15 through slot 23 and proximate to the lowermost portion thereof. The rod advancing means in the preferred embodiment of FIG. 1 comprises a toothed bar 26, a pawl 28, a yoke type bracket 29, and a pawl pivot pin 30. The bar 26 is positioned partially within the slot 22 and extends downwardly along the exterior of the slot 23. The lowermost portion of the bar 26 is secured to the rod 18 through the slot 23 with screw means 27. Thus, the rod 18 is slidable within the housing 15, the extent of movement being limited by screw means 27 within the longitudinal distance of the slot 23. In the lowermost position of rod 18, that is, with the spring in its relaxed state, the clamp portion 24 extends past the end of housing 15 as previously noted. Of course, the length of the rod 18 and slot 22 should be of proper dimension to permit complete movement of the bar rod assembly within the slot 23. The teeth of bar 26 face outwardly thereby allowing the pawl 28 pivotably mounted by the pin 30 on bracket 29 to engage said bar. The bracket 29 is attached to handle 12 and straddles the slot 22. The above arrangement is more clearly seen in FIG. 2, a cross section of FIG. 1 across plane 2—2, and in FIG. 3, an exploded partial front view of the device. Attachment of the bracket 29 to the handle 12 may be by any means compatible with the materials used in fabricating the handle. Screw means, rivots, welding, and the like can be used. Alternatively, when the handle 12 is a thermoplastic material the yoke bracket 29 may be bonded to the presoftened plastic.

Figure 5:
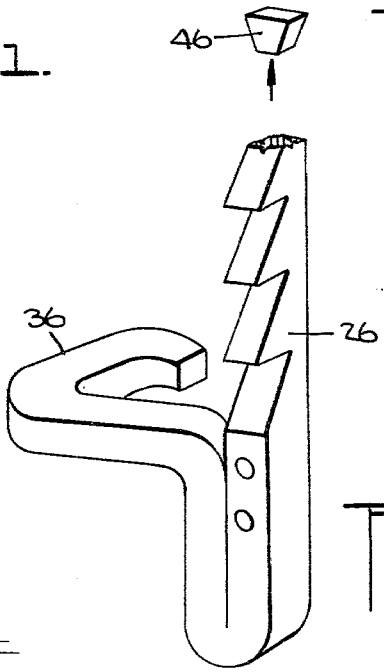
FIG. 5 is an alternate embodiment of the toothed bar.

As shown in FIG. 1 a hemicircular ring 35 having gripping means 36 can be positioned between the housing 15 and the bar 26. The ring 35 and gripping means 36 are slidable with respect to the housing, and provide handle means for manually moving the rod 18 independently of the pawl 28. Ring 35 also serves to prevent the bar 26 from becoming wedged within the slot 23. Alternatively, as shown in FIG. 5, the gripping means 36 may be unitary with the toothed bar 26. In this embodiment, ring 35 is not essential. However, if the ring is not used, the bar 26 should be slightly wider than the slot 23. The width of the slot 22, conversely, would be of sufficient width to permit passage of the bar 26 therethrough.

Clamp portion 24 comprises hemicylindrical clamp member 31 unitary to the rod 18, and hemicylindrical clamp member 32 pivotably mounted to the rod 18 using pivot means 33, the flat sides of each member juxtaposed. Optionally, each clamp member 31 and 32 comprises a half section of a wedge shaped keyway 34 on its interior surface.

Figure 4:
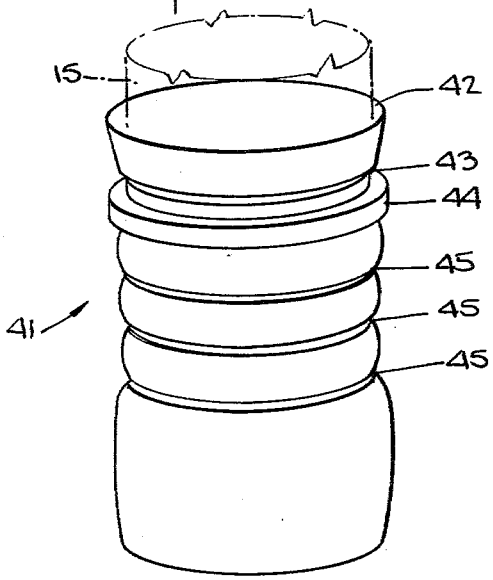
FIG. 4 is a drawing of the preferred litter collecting bag used with the device of the present invention.

The bottom of disposable plastic litter collecting bag 41, shown in FIG. 1 with phantom lines, is interposed between the clamp members 31 and 32, the sides of the bag being evertedly placed around the housing 15. The preferred bag 41 for use with this invention is shown in FIG. 4, the bag being shown evertedly so that the interior may be more clearly seen. The top 42 of the bag 41 is open. An annular elastic band 43 proximate to the open-end 42 is used to temporarily secure the bag in position around the housing 15, and also provides sealing means for the bag. Preferably, the collecting bag 41 also has a moisture absorbing annulus 44 adjacent to the band 43 and distal from the top 42, which assists in sealing the bag after it is drawn into the housing 15, and also absorbs moisture from litter thus retrieved. The bag 41 is provided with a plurality of annular constricting means 45 such as wrinkling bands in spaced relationship between the annulus 44 and the closed end of the bag 41 to give added rigidity without sacrificing requisite flexibility. A securing wedge 46 can be used to provide better gripping support between the bag 41 and the clamp members 31 and 32. The wedge fits tightly into keyway 34 which is formed when the clamp is closed. As is clearly shown in FIGS. 1 and 4, the exterior of the bag is interposed between the clamp members 31 and 32 while the interior of the bag is interposed with the securing wedge 46.

Figure 6:
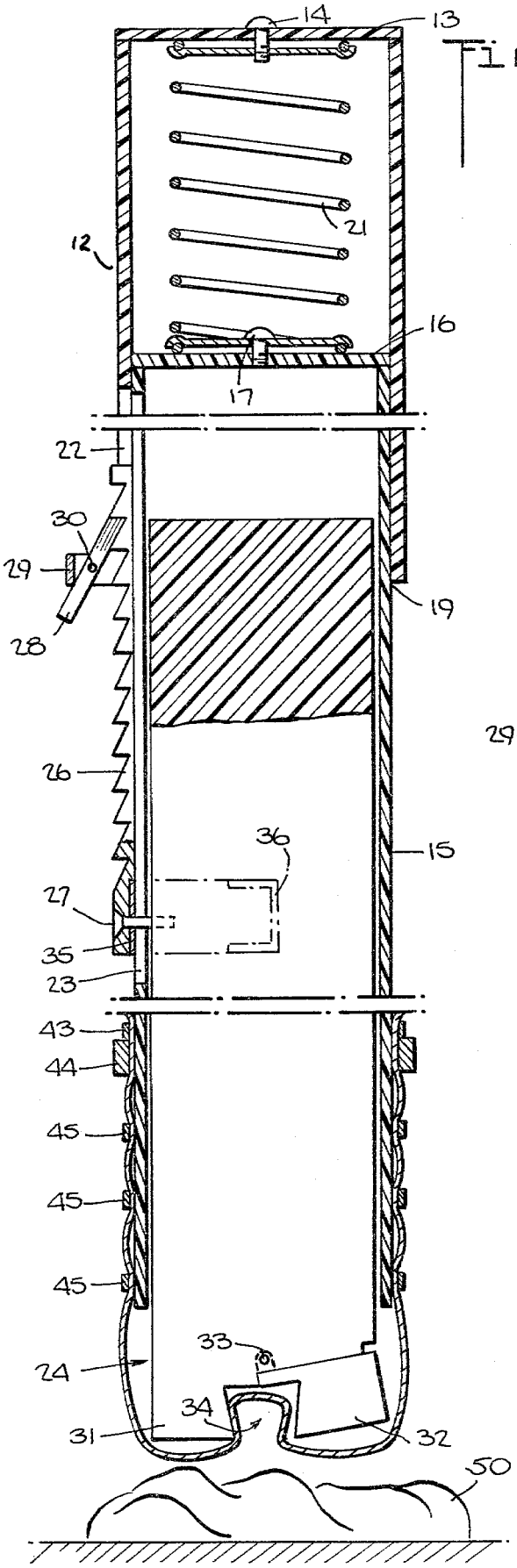
FIG. 6 is a cross sectional view of the device with litter bag in place prior to the use thereof.
Figure 7:
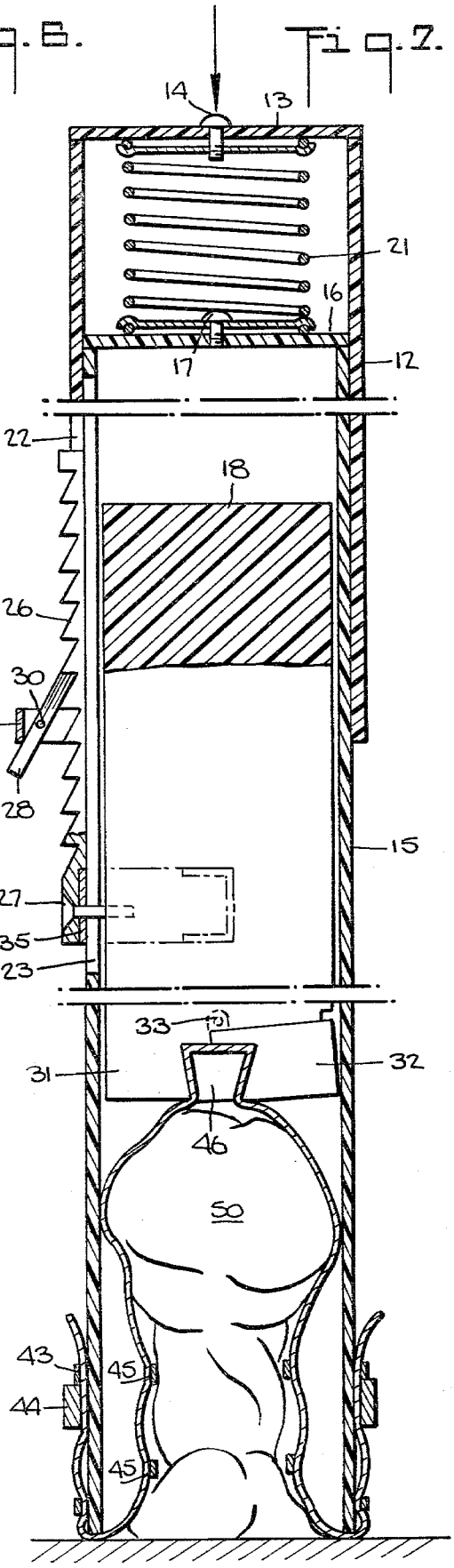
FIG. 7 is a cross sectional view of the device in use, litter having been retrieved into the litter bag.

Reference is now made FIGS. 6 and 7. FIG. 6 is a cross sectional view of the apparatus with litter bag in place just prior to use; FIG. 7 shows the device after litter has been retrieved into the bag and the housing. Clamp portion 24, with the bag 41 and optional wedge 46 in place as shown in FIG. 6 is raised into housing 15 by advancing the pawl 28 one or more notches on the bar 26, thereby securing the bag in place. This also provides an open space within the housing 15 and below the bag 41 for a portion of the litter 50. It should be understood that the housing 15 and rod 18 are at close tolerances with respect to one another thereby preventing inadvertant opening of the clamp 24 and release of bag 41.

Holding the handle 12, the retriever presses the secured bag into the litter and retrieves a portion which enters the open space of the bag within the housing. A force applied to the spring loaded handle advances the pawl within the toothed bar, thereby elevating the rod 18 permitting additional litter to be recovered as shown in FIG. 7. The litter is held within the housing by surface tension, and by the constricting means 45. The process is repeated until the litter is completely removed, and the elastic band 43 drawn into the housing, thereby sealing the bag 41. Annulus 44 absorbs any moisture associated with the litter thus retrieved. It should be noted that once the bag is secured in clamp portion 24, the operation of the device 11 is accomplished using only one hand, and litter retrieved without stooping. Gripping means 36 may then be employed to draw up the rod 18 with bag attached thereto to its uppermost position. When ready, the bag 41 may be dispensed by disengaging pawl 28, and returning the rod 18 at its lowermost position in slot 23 with gripping means 36. Pawl 28 may be disengaged by increasing tension on handle 12, and allowing the pawl to freely pivot away from the teeth.

FIG. 8 is an alternate embodiment 60 of the present invention wherein the upper section 61 of the rod 18 is hemicylindrical, the flat portion thereof having teeth or ogive notches 62. Handle 63 is slidably insertable in housing 15, the lowermost section 64 also being hemicylindrical, the flat portion thereof juxtaposed with the flat portion of section 61. A pawl 28 is pivotably fastened to the end of handle section 64, and is adapted to engage the teeth or notches 62. Spring 71 is slidable over the section 64 of the handle 63, and engages a lip 65 formed at the interface of the cylindrical and hemicylindrical sections thereof. The other end of the spring is fixedly connected to the housing 15 using any convenient means such as screw means 69 shown in FIG. 8. Gripping means 72 are connected to the rod 18 through slot 66 in housing 15 using screw means 67. In other respects, and in operation the device 11 is similar to its counterpart of FIG. 1.

It is to be understood that various deviations may be made from the foregoing preferred embodiments of the invention without departing from the main theme of the invention set forth in the claims which follows:

I claim:

1. A pet litter retrieval device wherein litter is collected into a container, the device comprising:

(a) a hollow cylindrical handle having at least one end open and a longitudinal slot extending from an open-end to the interior of the handle, (b) bracket means straddling the slot proximate to the open-end, (c) a pawl pivotably mounted in the bracket, (d) a hollow cylindrical housing having at least one open-end, the housing having a longitudinal slot between its ends, said housing slidably engaging the handle at the slotted end, an open-end extending therefrom, (e) an elongated retractable cylindrical rod, the first and slidably engaging the open-end of the housing extending from the handle, (f) clamp means at the second end of said rod to which the bottom of the container is secured, said container being then everted around the housing, (g) a toothed bar extending longitudinally from within the slot in the handle through the bracket means, and atop the slot in the housing, said slots being in longitudinal alignment, the toothed bar being connected at one end to the rod through the housing slot so that the clamp means extend past the housing when the bar is at its lowermost position within the housing slot, and (h) spring means connecting the handle to the housing whereby a force applied downwardly on the handle advances the pawl within the teeth of the bar thereby elevating the clamp body and container within said housing, the litter being collected within said container.

2. The device of claim 1 further comprising gripping means for positioning the bar and rod relative to the housing, said gripping means slidable with the bar relative to the housing.

3. The device of claim 2 wherein the gripping means is unitary to the bar.

4. A pet litter retrieval device wherein litter is collected into a container, the device comprising:

(a) a hollow cylindrical housing open at both ends, and having a longitudinal slot between said ends, (b) an elongated retractable rod, the rod being cylindrical at one end and hemicylindrical at the other, said hemicylindrical end having a plurality of teeth or notches on its flat surface, said hemicylindrical end slidably engaging the housing, (c) clamp means at the cylindrical end of the rod to which the bottom of the container is secured, said container being then everted around the housing, (d) an elongated handle cylindrical at one end, and hemicylindrical at the other, the hemicylindrical end slidably engaging the other end of the housing, the flat portions of the hemicylindrical ends of the rod and handle being juxtaposed, the handle also having a lip at the interface of the cylindrical and hemicylindrical sections, (e) a pawl pivotably mounted to the handle at the hemicylindrical end, (f) a spring slidably mounted around the handle and attached to the housing at one end, the other end of the spring in contact with the lip whereby a force directed downwardly on the handle advances the pawl within the teeth or notches of the rod thereby elevating said rod and container within said housing, the litter being collected within said container, and (g) gripping means attached exteriorly of the housing to the rod through the slot, the clamp means extending from the housing when said gripping means is at its lowermost position within the slot.

5. The device of claim 1 or 4 further comprising the container, said container being a flexible cylindrical litter collecting bag having on its interior surface an annular elastic litter bag sealing band around said bag proximate to its open end, said band slidingly securing the bag in an everted position around the housing proximate to the clamp means, a hollow moisture absorbing annulus adjacent to the sealing band distal to the open end of the bag, and a plurality of annular constricting means arranged in spaced relationship between the moisture absorbing annulus and the bottom of the bag, whereby litter taken into the bag is constrained by the constricting means, and the bag when raised essentially completely into the housing is sealed by the sealing band, moisture being absorbed by the moisture absorbing annulus adjacent thereto.

6. The device of claim 5 wherein the clamp means is comprised of a first hemicylindrical member unitary to the rod, and a second hemicylindrical member pivotably mounted to the rod, the flat surfaces of said members juxtaposed and provided with notches, said notches together forming a wedge shaped keyway, and the device being further comprised of a securing wedge, said wedge fitting into the keyway over the bag whereby the bag is secured within the clamp means.

* * * * *